US011781796B2

(12) United States Patent
You et al.

(10) Patent No.: US 11,781,796 B2
(45) **Date of Patent: *Oct. 10, 2023**

(54) REFRIGERATOR

(71) Applicant: LG ELECTRONICS INC., Seoul (KR)

(72) Inventors: Jimin You, Seoul (KR); Sangphil Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 27 days.

This patent is subject to a terminal disclaimer.

(21) Appl. No.: 17/396,068

(22) Filed: Aug. 6, 2021

(65) Prior Publication Data

US 2021/0364213 A1 Nov. 25, 2021

Related U.S. Application Data

(62) Division of application No. 16/526,294, filed on Jul. 30, 2019, now Pat. No. 11,112,159.

(30) Foreign Application Priority Data

Aug. 1, 2018 (KR) ..... 10-2018-0089933

(51) Int. Cl.
*F25C 1/25* (2018.01)
*F25D 23/12* (2006.01)
(Continued)

(52) U.S. Cl.
CPC ..... *F25C 1/25* (2018.01); *F25D 23/04* (2013.01); *F25D 23/126* (2013.01);
(Continued)

(58) Field of Classification Search
CPC ..... F25C 1/25; F25C 2400/14; F25D 23/04; F25D 23/126; F25D 31/002; F25D 2323/122; F25D 2323/024
See application file for complete search history.

(56) References Cited

U.S. PATENT DOCUMENTS 2,781,153 A 2/1957 Roberts
4,817,827 A * 4/1989 Kito ..... F25C 5/24 366/186

(Continued)

FOREIGN PATENT DOCUMENTS

CN 1151505 6/1997
CN 102472548 5/2012

(Continued)

OTHER PUBLICATIONS

European Search Report dated Jan. 2, 2020 issued in EP Application No. 19189410.4.

(Continued)

*Primary Examiner* — Marc E Norman

(74) *Attorney, Agent, or Firm* — KED & ASSOCIATES, LLP

(57) ABSTRACT

A refrigerator having a freezer compartment and a refrigerator compartment, the refrigerator including an icemaker provided at the freezer compartment door configured to open/close the freezer compartment, a dispenser provided at a refrigerator compartment door configured to open/close the refrigerator compartment, and a water tank provided at the refrigerator compartment door, the water tank having an inlet through which water is introduced into the water tank, a first outlet for supplying water to the dispenser, and a second outlet for supplying water to a pump, wherein the pump is configured to pump water from the water tank to the icemaker.

18 Claims, 5 Drawing Sheets

(51) Int. Cl.
*F25D 23/04* (2006.01)
*F25D 31/00* (2006.01)

(52) U.S. Cl.
CPC ..... *F25D 31/002* (2013.01); *F25C 2400/10* (2013.01); *F25C 2400/14* (2013.01); *F25D 2323/024* (2013.01); *F25D 2323/122* (2013.01)

(56) References Cited

U.S. PATENT DOCUMENTS

| | | | | |
|---|---|---|---|---|
| 5,813,246 | A | 9/1998 | Oh | |
| 5,971,213 | A | 10/1999 | Lee | |
| 9,010,144 | B2 | 4/2015 | Park et al. | |
| 9,085,453 | B2 | 7/2015 | McMahan | |
| 9,557,097 | B2 | 1/2017 | McMahan et al. | |
| 9,677,802 | B2 | 6/2017 | Lee | |
| 9,890,029 | B2 | 2/2018 | Comsa | |
| 9,915,468 | B2 | 3/2018 | You | |
| 10,215,477 | B2 | 2/2019 | Choo | |
| 11,112,159 | B2 * | 9/2021 | You | F25D 31/002 |
| 2006/0260345 | A1 | 11/2006 | Coulter et al. | |
| 2008/0156015 | A1 | 7/2008 | Meyerholtz et al. | |
| 2008/0168791 | A1 | 7/2008 | Nebbia et al. | |
| 2009/0151375 | A1 | 6/2009 | Tarr et al. | |
| 2010/0287971 | A1 | 11/2010 | Lee et al. | |
| 2011/0067433 | A1 | 3/2011 | An et al. | |
| 2012/0111049 | A1 | 5/2012 | Kim et al. | |
| 2012/0227433 | A1 | 9/2012 | Li | |
| 2013/0000345 | A1 * | 1/2013 | Vitan | F25C 5/22 62/344 |
| 2013/0133352 | A1 | 5/2013 | Park et al. | |
| 2014/0283542 | A1 | 9/2014 | Jang | |
| 2016/0083241 | A1 | 3/2016 | Koo | |
| 2016/0334158 | A1 | 11/2016 | Joo et al. | |
| 2016/0363246 | A1 | 12/2016 | Crompton | |
| 2020/0121121 | A1 * | 4/2020 | Zuo | A47J 31/469 |

FOREIGN PATENT DOCUMENTS

| | | |
|---|---|---|
| CN | 203534044 | 4/2014 |
| CN | 104110930 | 10/2014 |
| CN | 104344657 | 2/2015 |
| CN | 104613719 | 5/2015 |
| DE | 10 2007 023 304 | 11/2008 |
| EP | 2 600 085 | 6/2013 |
| EP | 3 406 992 | 11/2018 |
| GB | 2 118 700 | 11/1983 |
| IN | 201814017883 | 11/2018 |
| JP | H06-011228 | 2/1994 |
| JP | H07-260303 | 10/1995 |
| JP | 2002-115960 | 4/2002 |
| JP | 2006-162224 | 6/2006 |
| KR | 10-2005-0117830 | 12/2005 |
| KR | 10-2017-0096326 | 8/2017 |
| WO | WO 2011/000072 | 1/2011 |
| WO | WO 2011/019202 | 2/2011 |
| WO | WO 2011/159116 | 12/2011 |
| WO | WO 2013/022252 | 2/2013 |

OTHER PUBLICATIONS

European Search Report dated Jan. 20, 2020 issued in EP Application No. 19189406.2.
Australian Office Action dated Mar. 5, 2020 issued in Application No. 2019210609.
Australian Office Action dated Mar. 6, 2020 issued in Application No. 2019210604.
Indian Office Action dated Aug. 3, 2020 issued in Application 201914030956.
U. S. Office Action dated Feb. 19, 2021 issued in co-pending related U.S. Appl. No. 16/529,007.
Chinese Office Action dated Jan. 8, 2021 issued in Application No. 201910708246.7 (with English translation).
U. S. Office Action dated Feb. 5, 2021 issued in parent U.S. Appl. No. 16/526,294.
Chinese Notice of Allowance dated May 31, 2021 issued in Application No. 201910708246.7.
U.S. Notice of Allowance dated Jul. 14, 2021 issued in related U.S. Appl. No. 16/529,007.
Chinese Office Action dated Mar. 23, 2022 issued in CN Application No. 201910708247.1.
European Notice of Allowance dated Nov. 9, 2021 issued in Application No. 19189406.2.
U.S. Office Action dated Mar. 30, 2023 issued in U.S. Appl. No. 17/501,400.
U.S. Appl. No. 17/501,400, filed Oct. 14, 2021.
U.S. Appl. No. 17/396,068, filed Aug. 6, 2021.

* cited by examiner

REFRIGERATOR

CROSS-REFERENCE TO RELATED APPLICATIONS

This application is a Divisional Application of U.S. patent application Ser. No. 16/526,294 filed Jul. 30, 2019, which claims priority under 35 U.S.C. § 119 to Korean Application No. 10-2018-0089933 filed on Aug. 1, 2018, whose entire disclosures are hereby incorporated by reference.

BACKGROUND

1. Field

The present invention relates to a refrigerator, and more particularly, to a refrigerator having a dispenser and an icemaker.

2. Background

A refrigerator may be equipped with a food storage space capable of blocking external heat with a cabinet and door filled with heat insulator. The refrigerator may be equipped with a freezer consisting of an evaporator absorbing heat in the food storage space and a radiator discharging collected heat from the food storage space. Therefore, the refrigerator may control the food storage space to be maintained as a low-temperature area in which microorganisms have difficulties in survival and proliferation, thereby keeping the stored food away from spoiling for a long time.

A refrigerator may have a refrigerator compartment for storing food in a temperature area above zero and a freezer compartment for storing food in a temperature area below zero. According to the disposition of a refrigerator compartment and a freezer compartment, refrigerators may be classified into a top freezer refrigerator having a top freezer compartment and a bottom refrigerator compartment, a bottom freezer refrigerator having a top refrigerator compartment and a bottom freezer compartment, a side-by-side refrigerator having a left freezer compartment and a right refrigerator compartment, etc.

In order for a user to place or get the food stored in the food storage space conveniently, the refrigerator may be equipped with a multitude of racks, drawers and the like provided in the food storage space. The refrigerator door may be equipped with shelves, baskets and the like to store food, drinking water, etc.

The refrigerator may also be equipped with various convenience features. For example, the refrigerator may be equipped with a dispenser, an icemaker and the like. The dispenser may be a device for a user to get water (e.g., drinking water) without opening the refrigerator door. The icemaker may be a device for making and keeping ice by being located in the freezer compartment in general. In this case, water needs to be supplied to the dispenser and the icemaker.

BRIEF DESCRIPTION OF THE DRAWINGS

The embodiments will be described in detail with reference to the following drawings in which like reference numerals refer to like elements wherein.

DETAILED DESCRIPTION

Figure 1:
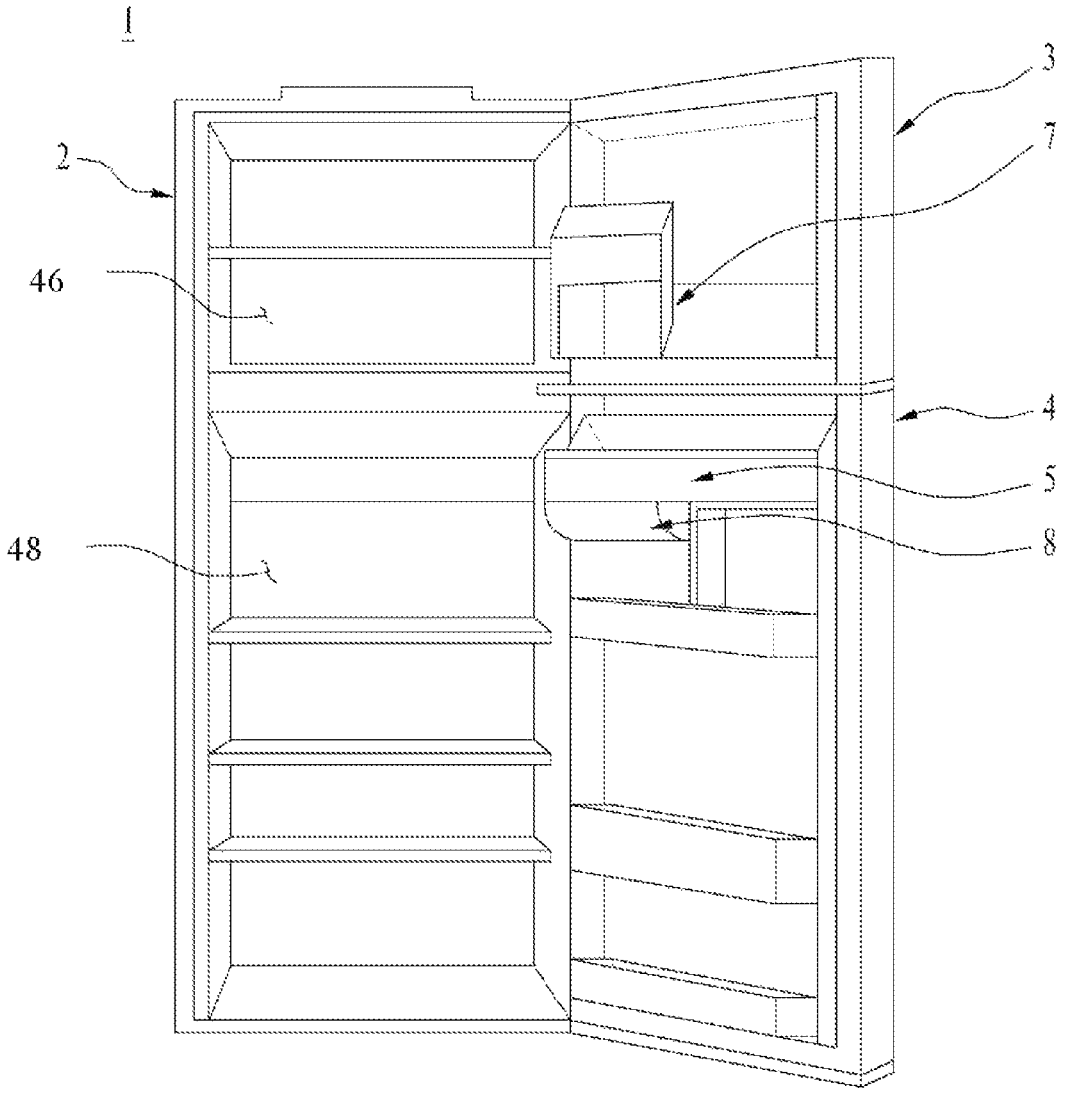
FIG. 1 is a front diagram showing a refrigerator according to an embodiment of the present disclosure.

An overall configuration of a refrigerator according to a preferred embodiment of the present disclosure is described with reference to FIG. 1. In the following description, a top-freezer refrigerator having a freezer compartment located provided to a top and a refrigerator compartment provided to a bottom is taken as an example.

For clarity of the following description, a refrigerator door direction shall be represented as a front and a freezer/refrigerator compartment direction shall be represented as a rear. Moreover, left and right directions are described with reference to viewing a refrigerator in a door direction.

A freezer compartment 46 may be provided to a top side of a cabinet 2 configuring an exterior of a refrigerator 1, and a refrigerator compartment 48 may be provided to a bottom side of the cabinet 2. A freezer compartment door 3 configured to open/close the freezer compartment 46 may be rotatable coupled to the freezer compartment 46. A refrigerator compartment door 4 configured to open/close the refrigerator compartment 48 may be rotatably coupled to the refrigerator compartment 48.

An icemaker 7 may be installed at the freezer compartment door 3 and a dispenser 9 (see FIG. 2) may be installed at the refrigerator compartment door 4. Although the icemaker 7 can be installed within the freezer compartment 46 or at the freezer compartment door 3, the following description is made by taking an example of installing the icemaker 7 at the freezer compartment door 3.

A water tank 5 configured to receive water therein may be removably provided to the refrigerator compartment door 4. A pump housing 8 may be provided under the water tank 5, and a pump may be installed within the pump housing 8.

The water of the water tank 5 may be provided to the dispenser and/or the icemaker 7 selectively or simultaneously. Namely, a passage for supplying the water of the water tank 5 to the dispenser may be provided between the water tank 5 and the dispenser and a passage for supplying the water of the water tank 5 to the icemaker 7 may be provided between the water tank 5 and the icemaker 7.

The water tank 5 may be preferably located over the dispenser. Therefore, the water supply from the water tank 5 to the dispenser may be achieved by gravity, i.e., free fall without using a separate pump. On the other hand, since the icemaker 7 may be provided to the freezer compartment door 3, the water of the water tank 5 may be sent to the icemaker 7 using a pump. An automatic icemaker may be used as the icemaker 7, by which the present invention is non-limited.

The water tank 5, the pump housing 8 and the dispenser 9 are described with reference to FIG. 2 as follows. First of all, the water of the water tank 5 may be supplied to each of the dispenser 9 and a pump 6 within the pump housing 8.

A first outlet 58 and a second outlet 57 may be provided to the water tank 5. The water may be supplied to the dispenser 9 and the pump 6 through the first outlet 58 and the second outlet 57, respectively.

While the water tank 5 may be separate from the refrigerator compartment door 4, since the first outlet 58 and the second outlet 57 are blocked or closed, the water of the water tank 5 may not be discharged externally. If a user couples the water tank 5 to the refrigerator compartment door 4, the first outlet 58 of the water tank 5 may be connected to the passage to the dispenser 9 and the second outlet 57 may be connected to the passage to the pump 6.

Water may be received in the water tank 5. The water of the water tank 5 may be supplied to the dispenser 9 and the icemaker 7. To this end, an inlet for putting external water into the water tank 5 may be provided to the water tank 5. A cap 56 for selectively opening/closing the inlet may be provided. The first outlet 58 for supplying water to the dispenser 9 may be provided to the water tank 5. The second outlet 57 for supplying water to the icemaker 7 may be provided to the water tank 5.

Although the water tank 5 may be formed integrally, it may be configured in a manner of including a container 52 and a cover 54. For clarity of the following description, the water tank 5 is described in a manner of being divided into the container 52 and the cover 54.

For example, the water tank 5 may include the container 52 having a prescribed space configured to receive water therein. The cover 54 may be removably coupled to a top side of the container 52. In order for a user to put water into the container 52, a cap 56 may be removably provided to the cover 54.

A shape of the container 52 is non-limited but may have an approximately hexahedral shape of which inside is empty. A width (i.e., right-to-left length) of the container 52 may be substantially equal to or slightly smaller than a width of the refrigerator compartment door. A depth (i.e., front-to-rear length) and thickness (i.e., top-to-bottom length) of the container 52 may be selected appropriately.

The first outlet 58 and the second outlet 57 may be provided to the container 52. Each of the first and second outlets 58 and 57 may be projected downward from a bottom of a front portion of the container 52. Water may be supplied to the dispenser 9 through the first outlet 58. Water may be supplied to the pump 6 within the pump housing 8 through the second outlet 57.

The first outlet 58 may be provided to the center of the container 52 approximately. Namely, as water is supplied to the dispenser 9 through the first outlet 58, the dispenser 9 may be located at the center of the refrigerator compartment door 4. Hence, if the first outlet 58 is disposed at the center of the container 52, it a length of a passage may be decreased.

The second outlet 57 may be provided in a manner of inclining to one side from the center of the container 52, and alternatively, a portion at which the hinge shaft of the refrigerator compartment door 4 is installed. Namely, the pump 6 may send water of the water tank 5 to the icemaker 7 provided to the freezer compartment door 3. The length of the passage connected to the icemaker 7 from the pump 6 may be decreased. To this end, the pump 6 may be provided to one side of the refrigerator compartment door 4, or to a place adjacent to a portion at which the hinge shaft is installed. Therefore, the second outlet 57 connected to the pump housing 8 having the pump 6 received therein may also be provided in a manner of inclining in a direction of the hinge shaft.

The first outlet 58 may be provided in a manner of inclining downward in a front direction (e.g., an outdoor direction) of the refrigerator compartment door 4. This is because the dispenser 9 connected to the first outlet 58 may be provided in front of the refrigerator compartment door 4. The second outlet 57 may be provided in a manner of having the substantially same inclination of the first outlet 58. Namely, if the first outlet 58 and the second outlet 57 differ from each other in inclination, it may not be easy to couple the water tank 5 to the refrigerator compartment door 4.

The inclinations of the first and second outlets 58 and 57 are described as follows. Although each of the first and second outlets 58 and 57 may have an inclination between horizontality (0°) and verticality (90°), it may have an inclination between 45° 90° preferably. This is because, if the first and second outlets 58 and 57 are formed horizontally, it may be possible to install the water tank 5 in a horizontal direction without interfering with other structures such as a rack, a basket and the like within the refrigerator compartment door 4. Yet, in this case, as the first and second outlets 58 and 57 are projected horizontally, it may be necessary to increase the thickness of the refrigerator compartment door 4.

Moreover, if the first and second outlets 58 and 57 are formed in a direction closer to a vertical direction, when the water tank 5 is installed at the refrigerator compartment door 4, interference with other structures of the refrigerator compartment door 4 may be generated. Although the height of the water tank 5 may be reduced to avoid such interference, the capacity or volume of the water tank 5 may be disadvantageously reduced.

Yet, if each of the first and second outlets 58 and 57 has an inclination between 45° and 90°, such requirements may be met as far as possible. Namely, it may be able to install the water tank 5 at the refrigerator compartment door 4 by minimizing the interference with other structures within the refrigerator compartment door 4 without reducing the capacity of the water tank 5 as well as increasing the thickness of the refrigerator compartment door 4.

The first outlet 58 and the second outlet 57 may be co-located on the front side of the water tank 5. Namely, when the first outlet 58 and the second outlet 57 are viewed in a lateral direction of the water tank 5, they may be located on the same line. This is because, if the first outlet 58 and the second outlet 57 are located on the front side and the rear side of the water tank 5, respectively, it may not be easy to couple the water tank 5 to the refrigerator compartment door 4.

Namely, when the water tank 5 is coupled to the refrigerator compartment door 4, the water tank 5 may interfere with racks of the refrigerator compartment door, which may be present above or below of the water tank, whereby the coupling is not facilitated. Moreover, if the first outlet 58 and the second outlet 57 are not located on the front side of the water tank 5, the passage from the water tank 5 to the refrigerator compartment door 4 may increase.

The coupling between the first outlet 58 and the dispenser 9 is described as follows. A valve 59 may be coupled to the first outlet 58 of the water tank 5, and the valve 59 may be coupled to the dispenser 9 through a dispenser connector 92. If a user pushes a lever 94, the valve 59 may open so that the water of the water tank 5 may be externally discharged through the first outlet 58 and the valve 59. As the structure of the dispenser 9 is popularly known and used, its details shall be omitted. For convenience and facilitation of assembly, an inclination angle of the first outlet 58 of the water tank 5 may be equal to that of the dispenser connector 92.

Structures of the second outlet 57 of the water tank 5 and the pump housing 8 are described as follows. First of all, the pump housing 8 is described. The pump housing 8 may be coupled to an inside of the refrigerator compartment door 4. The pump 6 may be provided within the pump housing 8. The pump housing 8 may include a front housing **8*a* and a rear housing 8***b* provided in rear of the front housing 8*a*. The front housing 8*a* may have an approximately hexahedral shape. The rear housing 8*b* may have a top-bottom height and a right-left width slightly greater than those of the front housing 8*b*. The rear housing 8*b* may play a role in supporting a portion of the water tank 5 installed over the rear housing 8*b* [See FIG. 3].

A passage connecting an entrance of the pump 6 and the second outlet 57 may be protected. To this end, a connecting member 80 may be provided between the pump housing 8 and the refrigerator compartment door 4.

A passage, e.g., a tube 62 may be received in the connecting member 80. The tube 62 may connect the entrance of the pump 6 and a connector 86 provided to the inner door of the refrigerator compartment door 4 [See FIG. 4].

The connecting member 80 of the pump housing 8 is described as follows. A tube joint 87 may be coupled to an outside of the front housing 8*a*, a tube guide 88 may be coupled to the tube joint 87, and the connector 86 may be coupled to the tube guide 88.

A gasket ring cover 82 may be coupled to an inside of the connector 86, and a gasket ring 84 may be received in an inner surface of the gasket ring cover 82. An annular ring 572, a spring 574 and a shaft 576 may be provided within the second outlet 57.

Figure 2:
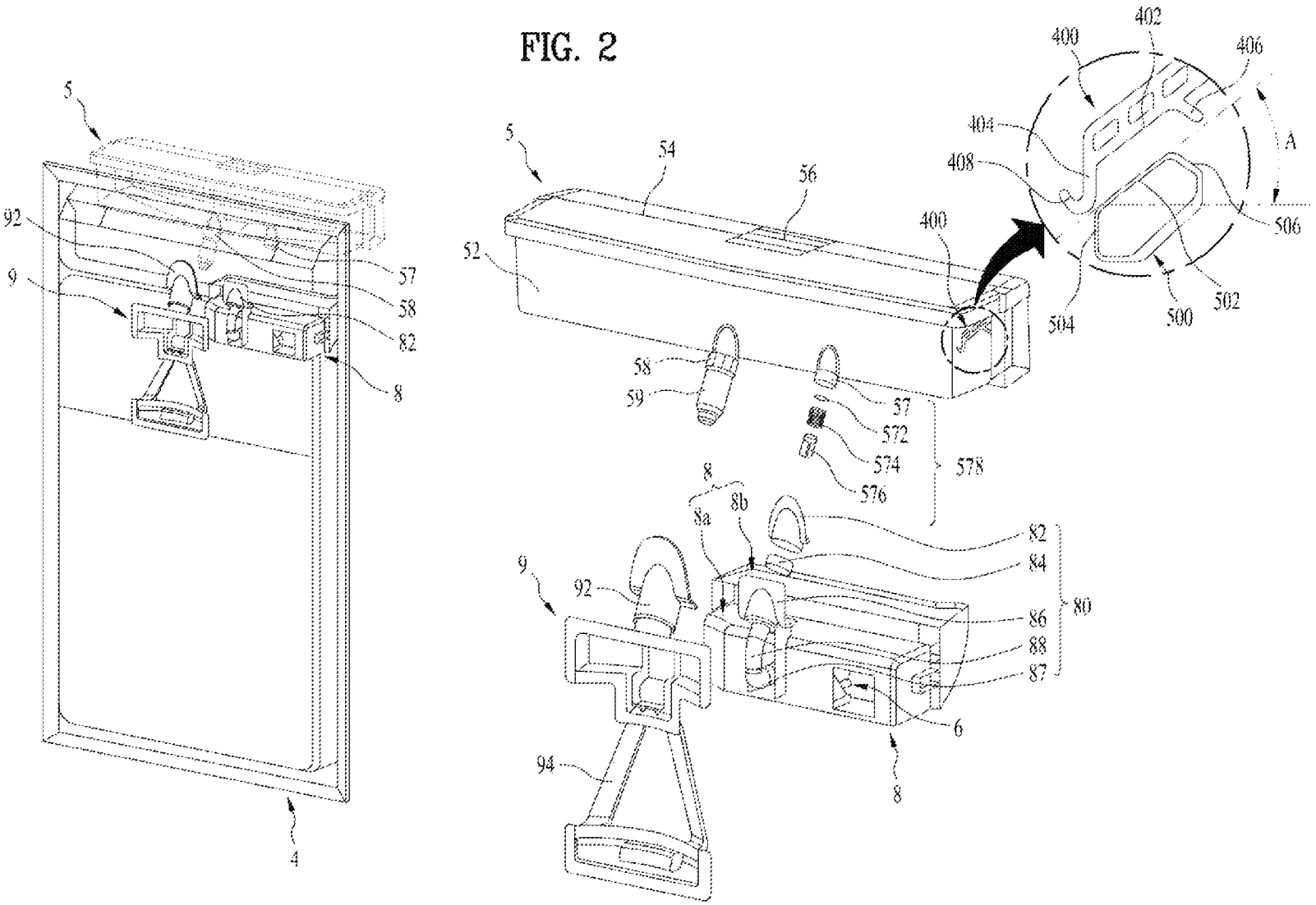
FIG. 2 is a perspective diagram showing a water tank, a dispenser and a pump housing shown in FIG. 1.
Figure 3:
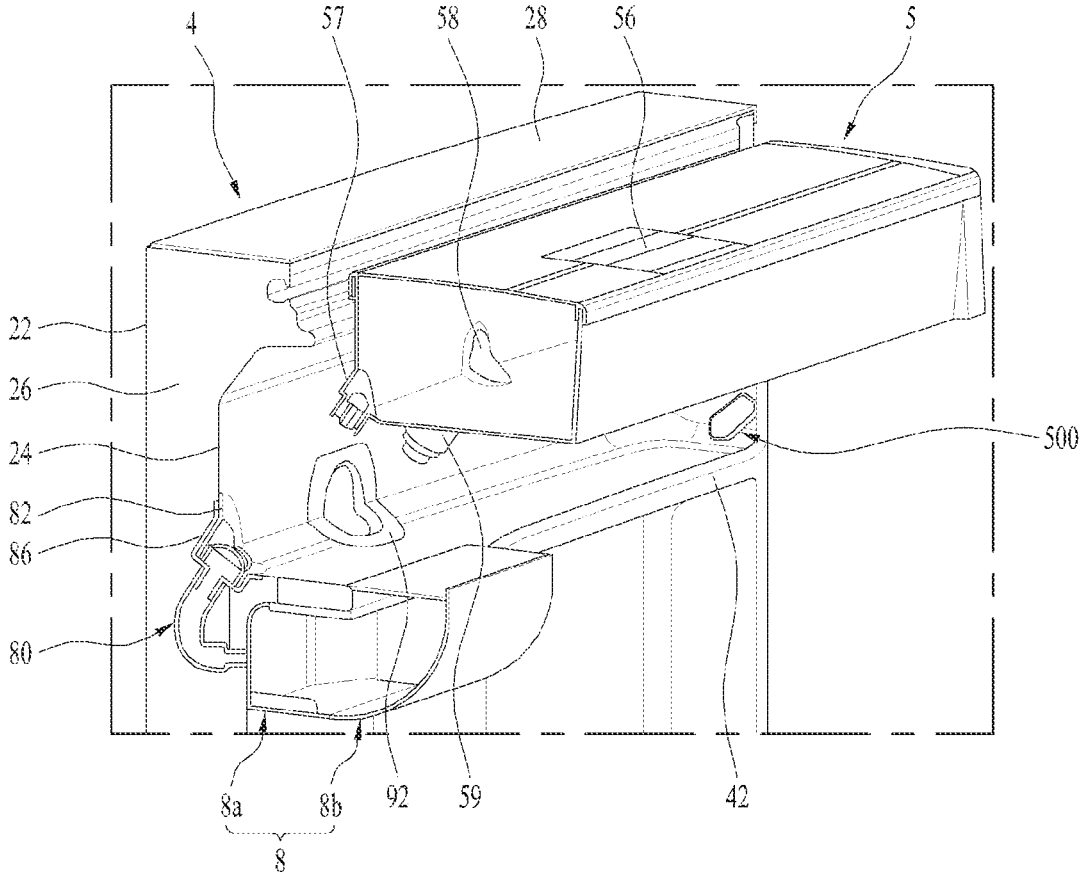
FIG. 3 is a partially-cut perspective diagram showing that a water tank shown in FIG. 1 is installed at a door.

With reference to FIG. 2 and FIG. 3, a structure that the water tank 5 is coupled to the refrigerator compartment door 4 is described as follows. The refrigerator compartment door 4 is described. The refrigerator compartment door 4 may include an outer door 22 and an inner door (e.g., a door liner) 24 coupled to the outer door 22.

A top cap deco 28 may be coupled to the top sides of the outer and inner doors 22 and 24, and a bottom cap deco may be coupled to the bottoms sides thereof. A space formed by the outer door 22, the inner door 24, the top cap deco 26 and the bottom cap deco may be filled with an insulator 26.

A seat portion 42 projected in an approximately horizontal direction may be provided to the inner door 24. The water tank 5 may be put on a top surface of the seat portion 42. The pump housing 8 may be coupled to a bottom side of the seat portion 42. The rear housing 8*b* of the pump housing 8 may be projected from the seat portion 42 in a rear direction, thereby playing a role in supporting the water tank 5.

A dispenser connector 92 may be coupled to an approximate center of the seat portion 42 of the inner door 24. The valve 59 coupled to the first outlet 58 of the water tank 5 may be inserted in the dispenser connector 92.

A gasket ring cover 82 may be provided next to the dispenser connector 92. The second outlet 57 of the water tank 5 may be inserted in the gasket ring cover 82. The connecting member 80 may be connected between the gasket ring cover 82 and the front housing 8*a*.

In order to facilitate the water tank 4 to be seated on the refrigerator compartment door 4, an inclination angle of the first outlet 58 in the front direction may be equal to that of the second outlet 57 in the front direction. An inclination angle of the dispenser connector 92 coupled to the first outlet 58 may be equal to that of the gasket ring cover 82 coupled to the second outlet 57.

In order to facilitate the water tank 5 to be attached to or detached from the refrigerator compartment door 4, an additional structure may be provided. Such a structure is described as follows.

A pair of support members 500 may be provided to an inside of the refrigerator compartment door 4, and a guide member 400 attached to or detached from the support member 500 may be provided to each of both lateral sides of the water tank 5. The support member 500 may be provided to an inside of each of both ends of the inner door 24 with a prescribed thickness. A door dike for seating a rack, a basket or the like may be provided to each of both sides of the inner door 24, and the support member 500 may be provided to the door dike.

The support member 500 may include a top surface portion 502 formed to have a prescribed inclination, a rear surface portion 506 descending at a prescribed angle from a rear of the top surface portion 502, and a front surface portion 504 descending at a prescribed angle from a front of the top surface portion 502. An inclination angle A of the top surface portion 502 may be smaller than an inclination angle of the second outlet 57 of the water tank 5. For example, the inclination angle A of the top surface portion 502 may be about 35° with a horizontal plane. The front surface portion 504 may be approximately vertical.

The guide member 400 provided to the water tank 5 may have a shape corresponding to that of the support member 500. The guide member may include a center portion 402, a rear portion 406 and a front portion 404. A projected portion 408 further extending in front direction may be provided in front of the front portion 404 of the guide member 400.

The inclination angles of the center portion 402, the rear portion 406 and the front portion 406 of the guide member 400 may correspond to the top surface portion 502, the rear surface portion 506 and the front surface portion 506 of the support member 500, respectively. Hence, if the water tank 5 is installed at the refrigerator compartment door 4, the center portion 402, the rear portion 406 and the front portion 406 of the guide member 400 may be supported by the top surface portion 502, the rear surface portion 506 and the front surface portion 506 of the support member 500, respectively.

In a general use state of the refrigerator, the water tank 5 may be coupled to the refrigerator compartment door 4. In this state, if the water tank 5 is empty, a user may open the cap 56 of the water tank 56 and then put water into the water tank 5. In case that a user cleans the water tank 5, the water tank 5 may be separated from the refrigerator compartment door 4.

When the water tank 5 is separated from the refrigerator compartment door 4, the first and second outlets 58 and 57 of the water tank 5 may be blocked so that the water of the water tank 5 is not discharged externally. When the water tank 5 is coupled to the refrigerator compartment door 4, the first and second outlets 58 and 57 of the water tank 5 may be open so that water may be supplied to the dispenser 9 and the pump 6.

The valve 59 may be installed at the first outlet 58 of the water tank 5. The valve 59 may normally be in a closed state. If a user pushes a lever 94 of the dispenser 9, the valve 59 may be open. Namely, as the valve 59 is coupled to the first outlet 58, a separate passage open/close structure may not be necessary. The valve 59 may be used for the dispenser 9 and its details shall be omitted.

On the other hand, when the water tank 5 is separated from the refrigerator compartment door 4, the second outlet 57 of the water tank 5 may have a closed passage. When the water tank 5 is coupled to the refrigerator compartment door 4, the second outlet 57 of the water tank 5 may have an open passage. When the water tank 5 is coupled to the refrigerator compartment door 4, the passage to the entrance of the pump 6 from the water tank 5 may be in an open state. By the operation of the pump, the water on the entrance side of the pump may be supplied to the icemaker 7.

Figure 4:
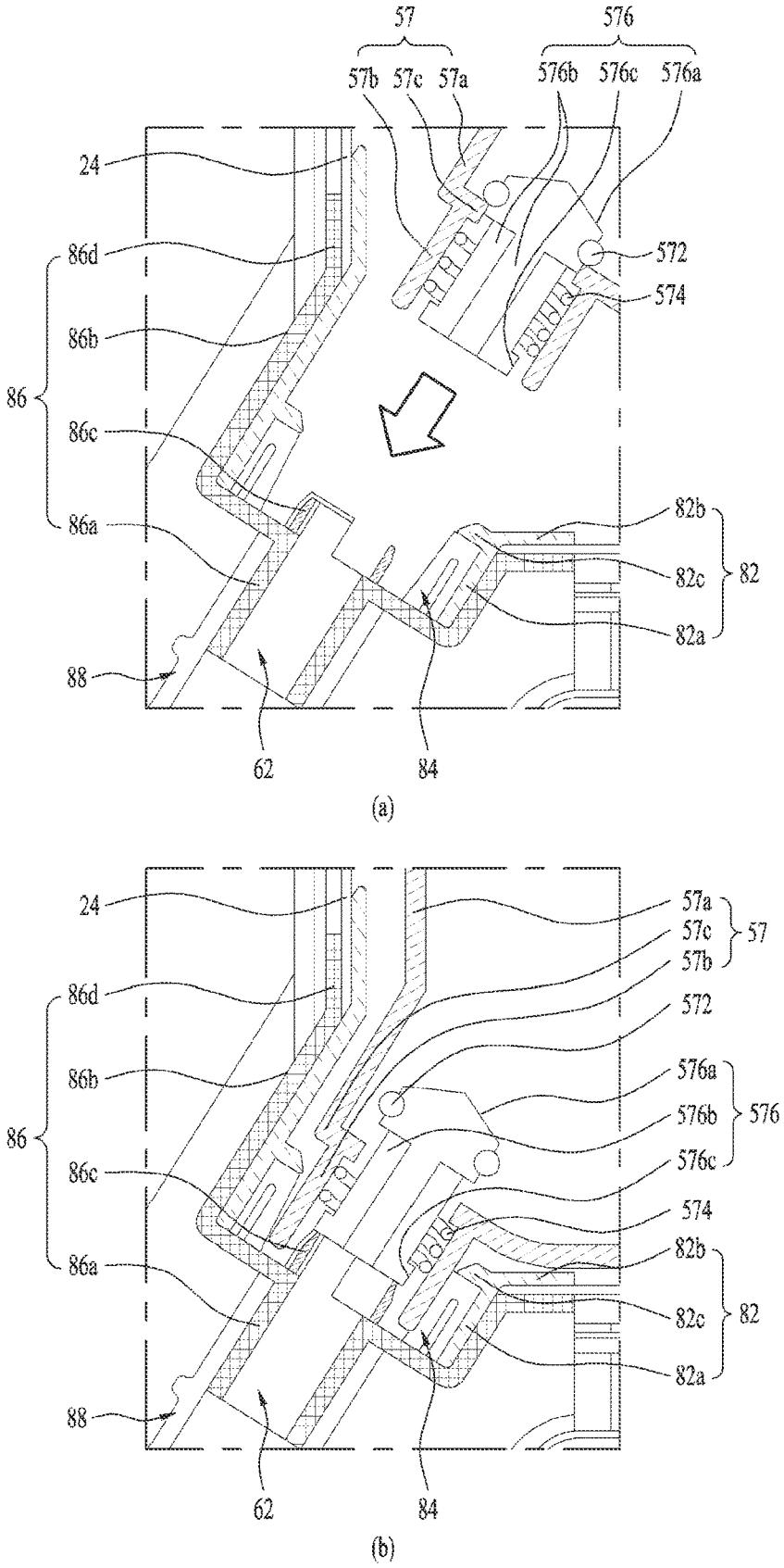
FIG. 4 is a cross-sectional diagram showing that a water tank shown in FIG. 1 is installed at a refrigerator compartment door.

With reference to FIG. 2 and FIG. 4, the open/closed structure of the passage of the second outlet 57 of the water tank 5 is described as follows. The structure of the second outlet 57 of the water tank 5 is described in detail. A switch 578 capable of selectively opening/closing the second outlet 57 may be provided to the second outlet 57. When the water tank 5 is separated from the refrigerator compartment door 4, the switch 578 may close the second outlet 57. When the water tank is coupled to the refrigerator compartment door 4, the switch 578 may open the second outlet 57.

One embodiment of the switch 578 is described as follows. The second outlet 57 of the switch 578 is described. A small-diameter portion 57*b* having a small diameter may be provided to a tip of the second outlet 57 of the water tank 5. A protruding portion 57*c* protruding inward may be provided to a portion from which the small-diameter portion 57*b* begins. A spring 574 may be installed within the small-diameter portion 57*b*, and the protruding portion 57*c* may play a role in supporting a top portion of the spring 574.

A shaft 576 may be installed in the small-diameter portion 57*b*. The shaft 576 may include a head portion 576*a* having a big diameter and a body portion 576*b* extending downward from the head portion 576*a*. An annular ring 572 may be put on the head portion 576*a*, whereby water leakage may be prevented.

The body portion 576*b* may be configured in a manner that 4 thin panel-type members alternate one another in a radial direction at the center of the shaft 576 and has a cross-shaped cross-section. Space among the 4 panel-type members may become a passage through which water passes. A catch portion 576*c* extending in a radial direction may be provided to a bottom end of the body portion 576*b*, and a bottom end of the spring 574 may be supported by the catch portion 576*c*.

Next, the structure of the coupling part of the pump housing 8 is described. The connector 86 may be provided to the inner door 24 of the refrigerator compartment door 4. The second outlet 57 may be selectively connected to the connector 86. When the second outlet 57 is coupled to the connector 86, water leakage may be prevented preferably. Hence, the gasket ring 84 may be provided to an inside of the connector 86. The gasket ring 84 may be supported by the gasket ring cover 82.

One end of the tube guide 88 may be connected to the connector 86, and the other end of the tub guide 88 may be connected to the tube joint 87 coupled to the pump housing 8. A passage (e.g., a tube) connected to the entrance of the pump 6 may be connected to the connector 86.

This is described in detail as follows. The tube joint 87 may be coupled to an outside of the pump housing 8, and the tube guide 88 may be coupled to the other side of the tube joint 87. The connector 86 may be coupled to the other end of the tube guide 88.

The connector 86 may include a small-diameter portion 86*a* inserted and coupled to an inside of the tube guide 88, and a projected portion (or projection) 86*c* projected upward may be provided to a top surface of the small-diameter portion 86*a*. A large-diameter portion 86*b* having a diameter greater than that of the small-diameter portion 86*a* may be formed on the small-diameter portion 86*a*. A tube-expanding portion 86*d* extending in a radial direction by inclining upward may be formed on the large-diameter portion 86*b*.

The gasket ring cover 82 may be coupled to the inner surfaces of the large-diameter portion 86*b* and the tube-expanding portion 86*d* of the connector 86. Hence, the gasket ring cover 82 may approximately have the shape corresponding to the large-diameter portion 86*b* and the tube-expanding portion 86*d* of the connector 86.

The gasket ring cover 82 may include a portion 82*a* corresponding to the large-diameter portion 86*b* of the connector 86 and a portion 82*b* corresponding to the tube-expanding portion 86*b*. The gasket ring 84 may be received in an inner bottom of the gasket ring cover 82. A protruding portion 82*c* protruding inward may be formed at a prescribed position of the gasket ring cover 82 so as to prevent the gasket ring 84 from being pulled out.

The tip 82*b* of the gasket ring cover 82 may be coupled to a front side of the inner door 24 and the tip 86*d* of the connector 86 of the connecting member 80 may be coupled to a rear side of the inner door 24.

The first outlet may be inclined in a front direction. Accordingly, the gasket ring cover 82 and the connector 86 may be installed to have the same inclination angle.

The attaching/detaching process for the second outlet 57 of the water tank 5 and the connecting member 80 of the pump housing 8 is described as follows. With reference to FIG. 4 (*a*), a state that the water tank 5 is separated from the refrigerator compartment door 4 is described. In this state, the spring 574 installed within the second outlet 57 may pull the shaft 576 downward. Hence, the annular ring (or O-ring) 572 provided to the head portion 576*a* of the shaft 576 may contact the protruding portion 57*c* of the second outlet 57, whereby water is not discharged out of the second outlet 57.

Next, with reference to FIG. 4 (*b*), a state that the water tank 5 is coupled to the refrigerator compartment door 4 is described. If the water tank 5 is coupled to the refrigerator compartment door 4, the second outlet 57 of the water tank 5 may be inserted in the gasket ring cover 82.

Once the insertion is complete, the projected portion 86*c* of the connector 86 may push the shaft 576 upward. Once the shaft 576 is moved upward, the head portion 576*a* of the shaft 576 may be spaced apart from the protruding portion 57*c* of the second outlet 57.

Therefore, there may be a gap between the head portion 576*a* of the shaft 576 and the protruding portion 57*c*, whereby water of the water tank 5 may be discharged in the direction of the tube 62 through the gap. In doing so, as the small-diameter portion 57*a* of the second outlet 57 of the water tank 5 is already inserted in the gasket ring 84, the water leakage may be prevented by the gasket ring 84.

Figure 5:
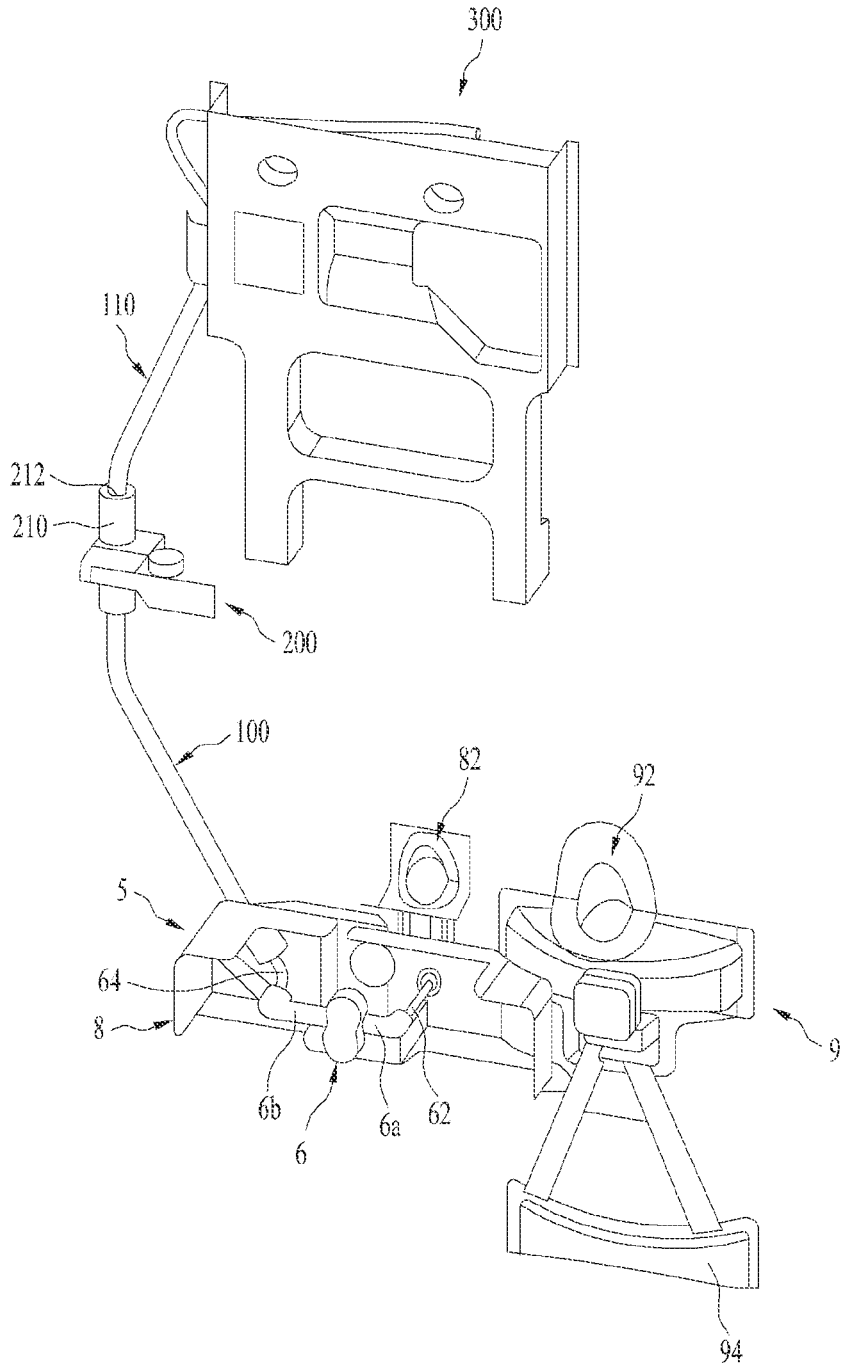
FIG. 5 is a perspective diagram showing a passage to a pump and icemaker from a water tank shown in FIG. 1.

With reference to FIG. 3 and FIG. 5, the passages from the water tank 5 to the dispenser 9 and the icemaker 7 are described as follows. The passage from the water tank 5 to the dispenser 9 is described.

The water tank 5 may be located above the dispenser 9. The valve 59 connected to the first outlet 58 of the water tank 5 may be coupled to a dispenser connector 92. The passage between the water tank 5 and the dispenser 9 may be relatively short.

As the water tank 5 is located above the dispenser 9, a separate pump may be unnecessary. If a user pushes the lever 94, the valve 59 may be opened and the water of the water tank 5 may be discharged to the dispenser 9 by gravity.

Next, the passage from the water tank 5 to the icemaker 7 is described with reference to FIG. 5. The water tank 5 may be provided to the refrigerator compartment door 4. Yet, since the icemaker 7 may be provided to the freezer compartment door 3 located above the water tank 5, the pump 6 may be required in order to send the water of the water tank 5 to the icemaker 7. The supply of water to the icemaker 7 may be performed selectively. Namely, water may be supplied to the icemaker 7 when an ice tray is empty. Hence, although the icemaker 7 may be located below the water tank 5, the pump 6 may be used.

The passage from the water tank 5 to the icemaker 7 may include a passage from the water tank 5 to the entrance 6*a* of the pump 6 and a passage from the exit 6*b* of the pump 6 to the icemaker 7. A substantial passage from the water tank 5 to the entrance 6*a* of the pump 6 may be the tube 62 starting from the second outlet 57 of the water tank 5 up to the entrance 6*a* of the pump 6 via the connector 36.

Next, the passage connecting the exit 6*b* of the pump 6 to the icemaker 7 is described. The pump 6 may be installed at the refrigerator compartment door 4, and the icemaker 7 may be installed at the freezer compartment door 3. Hence, the passage from the pump 6 to the icemaker 7 may connect the refrigerator compartment to the freezer compartment.

The connection of the passage from the refrigerator compartment to the freezer compartment may use a hinge shaft 210 of a hinge member 200. For example, the passage from the refrigerator compartment to the freezer compartment may be connected in a manner of using a hollow shaft as the hinge shaft 210 and also using a hollow portion 212 of the hinge shaft 210.

The passage from the exit 6*b* of the pump 6 to the icemaker 7 may use the tube 64 having flexibility. To protect the tube, the tube 64 may be received in a tube guide 100. The tube guide 100 may include a hollow pipe capable of receiving the tube therein and may use a material having relative durability.

The tube guide 100 may be connected between the pump housing 8 and the hinge shat 210. Another tube guide 110 may be connected between the hinge shaft 210 and the icemaker 7. The tube guide 100 may directly pass through the hollow portion 212 of the hinge shaft 210. Or, since the hinge shaft 210 may be generally formed of metallic material, the tube 64 may directly pass through the hollow portion 212 of the hinge shaft 210 without using the tube guide 100 for the hollow portion 212 of the hinge shaft 210.

The tube guide 100 from the pump housing 8 to the hinge shaft 210 may be buried in the insulator of the refrigerator compartment door. The tube guide 110 from the hinge shaft 210 to the icemaker 7 may be buried in the insulator of the freezer compartment door.

With reference to FIG. 2 and FIG. 3, an operation of the water tank 5 of the refrigerator according to the present embodiment is described as follows. The water tank 5 may be removable from the refrigerator compartment door 4. For example, when the water tank 5 is cleaned, a user may separate the water tank 5 from the refrigerator compartment door 4. While the water tank 5 is separated, water may not be discharged through the first and second outlets 58 and 57 of the water tank 5.

This is because the first outlet 58 may be in a state that the passage is blocked by the valve 59 coupled to the first outlet 58. The second outlet 57 may have the passage blocked by the annular ring 572, the spring 574 and the shaft 576 installed within the second outlet 57.

Once the user finishes the cleaning of the water tank 5, the user may install the water tank 5 at the refrigerator compartment door 4 again. In doing so, the user may easily seat the water tank 5 on the refrigerator compartment door 4 without interference with other components such as a rack, a basket and the like. This is because the first and second outlets 58 and 57 of the water tank 5 may be projected downward at the same inclination angle in a front direction. When the first outlet 58 and the second outlet 57 are viewed in a lateral direction of the water tank 5, they may be located on the same line. Hence, the water tank 5 may be seated more conveniently and easily.

Once the water tank 5 is seated on the refrigerator compartment door 4, the water of the water tank 5 may be supplied to the dispenser 9 and/or the icemaker 7. As the passage of the valve 59 coupled to the first outlet 58 may be blocked even in the state that the water tank 5 is seated on the refrigerator compartment door 4, water may not be discharged through the first outlet 58. Yet, if a user pushes the lever 94 of the dispenser 9, an open signal may be sent to the valve 59 so as to open the valve 59. As the valve 59 is open, water may be discharged to the dispenser 9.

While the water tank 5 is seated on the refrigerator compartment door 4, water of the water tank 5 may be supplied to the entrance of the pump 6 through the second outlet 57. Yet, if the pump 6 does not operate, the water may reach the pump entrance side only. In this state, if a drive signal of the pump is sent to the pump 6 from the icemaker 7, the pump 6 may operate to supply water to the icemaker 7.

If the water of the water tank 5 is used all in the state that while the water tank 5 is seated on the refrigerator compartment door 4, a user may open the cap 56 of the water tank 5 and put water into the water tank 5 through the cap 56. As described above, according to the present disclosure, water may be advantageously supplied to the dispenser 9 and the icemaker 7 using the single water tank 5, whereby convenience in using the refrigerator is enhanced.

And, owing to the structures of the first and second outlets 58 and 57 of the water tank 5, a user may conveniently install/separate the water tank at/from the refrigerator compartment door 4. Moreover, the passage from the water tank 5 to the dispenser 9 and the icemaker 7 may be minimized advantageously.

The matter of the above-described embodiment is identically applicable to other undescribed parts. Moreover, the technical matter described in one embodiment is identically applicable to another embodiment if it is not contrary mutually, unless otherwise specifically stated.

The top-freezer refrigerator is exemplarily described in the above embodiment, by which the present embodiment is non-limited. For example, the principle of the present disclosure is applicable to a bottom-freezer refrigerator. In this case, a water tank and a dispenser may be installed at a refrigerator compartment door and an icemaker may be installed in a freezer compartment. Although the water tank is located above the icemaker installed in the freezer compartment, water may be selectively supplied to the icemaker. Hence, a pump may be used. Particularly, an auto-icemaker may use a pump.

The principle of the present disclosure is applicable to a side-by-side refrigerator. In this case, a water tank and a dispenser may be installed at a refrigerator compartment door and an icemaker may be installed in a freezer compartment. The icemaker installed in the freezer compartment may be installed higher or lower than the water tank. Since water may be selectively supplied to the icemaker irrespective of the water tank installation height, a pump may be used as well.

It will be appreciated by those skilled in the art that various modifications and variations can be made in the present disclosure without departing from the spirit or scope of the embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

Accordingly, embodiments of the present disclosure are directed to a refrigerator that substantially obviates one or more problems due to limitations and disadvantages of the related art.

An object of the present disclosure is to provide a refrigerator capable of supplying water to a dispenser and an icemaker efficiently using a single water tank. Another object of the present disclosure is to provide a refrigerator, by which a water supply passage can be simplified while supplying water to a dispenser and an icemaker efficiently using a single water tank.

A further object of the present disclosure is to provide a refrigerator having a dispenser and an icemaker, by which user's convenience is improved. Additional advantages, objects, and features of the disclosure will be set forth in the disclosure herein as well as the accompanying drawings. Such aspects may also be appreciated by those skilled in the art based on the disclosure herein.

The present disclosure may supply water to a dispenser and an icemaker from a single water tank. The present disclosure may be applicable to a refrigerator having a refrigerator compartment and a freezer compartment. The present disclosure may be applicable to a refrigerator having a freezer compartment located at the top and a refrigerator compartment located at the bottom.

The dispenser may be provided to a refrigerator compartment door and the icemaker may be provided to the freezer compartment or a freezer compartment door. The water tank may be provided to the refrigerator compartment door, and a water supply passage may be connected to each of the dispenser and the icemaker from the water tank.

The water tank may be disposed over the dispenser so that water in the water tank can be supplied to the dispenser by gravity. A pump for sending water of the water tank to the icemaker may be usable. And, the pump may be disposed under the eater tank.

The water tank may have a first outlet for discharging water to the dispenser and a second outlet for discharging water to the icemaker. Each of the first and second outlets may be projected from a lower part of the water tank toward a front side and configured in a manner of inclining at a prescribed angle. In a lateral view of the water tank, the first outlet and the second outlet may be disposed on the same line.

A passage to an entrance of the pump from the second outlet of the water tank may use an inside of the refrigerator compartment door, i.e., a space between an outer door and an inner door. A connector selectively removable from the second outlet may be provided to the inner door.

A passage to the icemaker from an exit of the pump may use the inside of the refrigerator compartment door, i.e., the space between in the outer door and the inner door. A passage between the refrigerator compartment and the freezer compartment may use a hinge shaft of a refrigerator door. For example, a hollow shaft may be used as the hinge shaft, whereby the passage between the refrigerator compartment and the freezer compartment may be connected through a hollow portion of the hollow shaft.

A refrigerator having a freezer compartment and a refrigerator compartment according to one embodiment of the present disclosure may include an icemaker provided to the freezer compartment or a freezer compartment door configured to open/close the freezer compartment, a dispenser provided to a refrigerator compartment door configured to open/close the refrigerator compartment, a pump configured to send the water supplied from the water tank to the icemaker, and a water tank provided to the refrigerator compartment door, the water tank having an inlet for putting in water, a first outlet for supplying water to the dispenser, and a second outlet for supplying water to the pump.

The refrigerator may further include a cap configured to selectively open/close the inlet. The first outlet and the second outlet may be provided to a bottom side of the water tank. The first outlet and the second outlet may be provided in a manner of inclining downward at the same angle with the water tank in a front direction.

The first outlet and the second outlet may be located on the same line when viewed in a lateral direction of the water tank. A valve configured to selectively open/close the first outlet may be provided to the first outlet.

A switch configured to selectively open/close the second outlet may be provided to the second outlet. If the water tank is separated from the refrigerator compartment door, the switch may close the second outlet. If the water tank is installed at the refrigerator compartment door, the switch may open the second outlet.

A support member may be provided to an inside of the refrigerator compartment door and a guide member detachable from the support member may be provided to a lateral side of the water tank. The support member may include a top surface portion having a prescribed inclination, a rear surface portion descending at a prescribed angle from a rear of the top surface portion and a front surface portion descending at a prescribed angle from a front of the top surface portion and the guide member may include a center portion, a rear portion and a front portion corresponding to the top surface portion, the rear surface portion and the front surface portion, respectively.

An inclination angle of the support member may be smaller than an inclination angle of the second outlet of the water tank. The refrigerator may further include a pump housing configured to receive the pump therein and a connecting member may be provided between the second outlet and the pump housing.

A connector may be provided to the refrigerator compartment door and the second outlet of the water tank may be selectively connected to the connector. The connector may include a small-diameter portion, a large-diameter portion on the small-diameter portion and a tube-expanding portion on the large-diameter portion.

The switch may be movable in an axial direction, a protruding portion may be provided to a top side of the small-diameter portion of the connector, and wherein the switch may be moved upward by the protruding portion. A gasket ring cover may be provided to an inside of the connector and a gasket ring may be provided to an inside of the gasket ring cover.

The gasket ring cover and the connector may be disposed to have the same inclination of the second outlet. An inner door of the refrigerator compartment door may be inserted between a tip of the gasket ring cover and a tip of the connector.

The refrigerator may further include a tube connecting the pump and the icemaker and the tube may pass through a hollow portion of a hinge shaft of the refrigerator compartment door. The refrigerator may further include a tube guide configured to receive the tube therein.

The respective features of the above-described embodiments can be configured in a manner of being combined with other embodiments unless contradictory or exclusive to other embodiments. Accordingly, a refrigerator according to the present disclosure may provide the following effects or advantages.

First of all, water may be supplied to a dispenser and an icemaker efficiently using a single water tank. Secondly, a passage to a dispenser and an icemaker may be simplified despite using a single water tank.

Thirdly, user's convenience may be improved by supplying water to a dispenser and an icemaker using a single water tank. Effects obtainable from the present disclosure may be non-limited by the above mentioned effect. And, other unmentioned effects can be clearly understood from the following description by those having ordinary skill in the technical field to which the present disclosure pertains.

It is to be understood that both the foregoing general description and the following detailed description of the present disclosure are exemplary and explanatory and are intended to provide further explanation of the disclosure as claimed.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

an icemaker configured to make ice;

a dispenser configured to dispense water; and a water tank provided at a refrigerator door, the water tank having an inlet, a first outlet configured to supply water via a first water path from the water tank to the dispenser, and a second outlet configured to supply water via a second water path from the water tank to the icemaker, wherein the second outlet of the water tank is separately provided from the first outlet of the water tank, thereby the entire first water path from the water tank to the dispenser is separated from the entire second water path from the water tank to the icemaker.

2. The refrigerator of claim 1, wherein the first outlet and the second outlet are arranged at a bottom side of the water tank and are inclined downward at a same angle with respect to the water tank toward a front of the refrigerator.

3. The refrigerator of claim 2, wherein the first outlet and the second outlet are parallel to each other.

4. The refrigerator of claim 1, wherein a valve configured to open or close the first outlet is attached to the first outlet.

5. The refrigerator of claim 1, wherein a switch configured to open or close the second outlet is attached to the second outlet.

6. The refrigerator of claim 5, wherein when the water tank is separated from the refrigerator door, the switch closes the second outlet and wherein when the water tank is installed at the refrigerator door, the switch opens the second outlet.

7. The refrigerator of claim 6, wherein a support bracket is provided at an inside of the refrigerator door and wherein a guide member is provided to a lateral side of the water tank, wherein the guide member is configured to be seated on the support bracket when the water tank is installed at the refrigerator door.

8. The refrigerator of claim 7, wherein the support bracket comprises a top surface having a first inclination with respect to a horizontal line, a rear surface that projects at a first angle with respect to the top surface from a rear of the top surface, and a front surface that projects at a second angle with respect to the top surface from a front of the top surface and wherein the guide member comprises a center portion, a rear portion, and a front portion that respectively correspond to the top surface, the rear surface, and the front surface of the support bracket.

9. The refrigerator of claim 8, wherein an inclination angle of the support bracket with respect to the horizontal line is smaller than an inclination angle of the second outlet of the water tank with respect to the horizontal line.

10. The refrigerator of claim 1, further comprising a pump between the water tank and the icemaker and a pump housing configured to receive the pump therein, wherein the pump housing comprises a connector that allows the second outlet to communicate with the pump housing.

11. The refrigerator of claim 10, wherein the second outlet of the water tank is selectively connected to the connector according to an installation state of the water tank.

12. The refrigerator of claim 11, wherein the connector comprises a first end having a first diameter, a second end having a second diameter larger than the first diameter, and a flange that projects outward from the second end.

13. The refrigerator of claim 12, wherein the switch is configured to reciprocate in an axial direction, and wherein the connector includes an annular projection configured to push the switch so as to open the second outlet.

14. The refrigerator of claim 11, wherein a gasket ring cover is provided at an inside of the connector and wherein a gasket ring is provided at an inside of the connector and held in place by the gasket ring cover.

15. The refrigerator of claim 14, wherein the gasket ring cover and the connector are inclined to the same degree as the second outlet with respect to the horizontal line.

16. The refrigerator of claim 15, wherein a portion of an inner door of the refrigerator door is provided between the gasket ring cover and the connector.

17. The refrigerator of claim 1, further comprising a freezing compartment and a refrigerating compartment, and wherein the icemaker is provided at the freezing compartment and the dispenser is provided at the refrigerator door.

18. The refrigerator of claim 17, wherein a pump is provided below the water tank, the icemaker is provided above the water tank and the water tank is provided above the dispenser.

* * * * *